US010973257B2

(12) United States Patent
Schretter

(10) Patent No.: US 10,973,257 B2
(45) Date of Patent: Apr. 13, 2021

(54) SMOKING ACCESSORY CONTAINER

(71) Applicant: Richard Lee Schretter, Bolingbrook, IL (US)

(72) Inventor: Richard Lee Schretter, Bolingbrook, IL (US)

(73) Assignee: Richard Schretter, Bolingbrook, IL (US)

( * ) Notice: Subject to any disclaimer, the term of this patent is extended or adjusted under 35 U.S.C. 154(b) by 111 days.

(21) Appl. No.: 16/382,836

(22) Filed: Apr. 12, 2019

(65) Prior Publication Data

US 2020/0323262 A1 Oct. 15, 2020

(51) Int. Cl.
*A24F 9/02* (2006.01)
*A24F 9/04* (2006.01)
*A24F 23/04* (2006.01)

(52) U.S. Cl.
CPC ..... *A24F 23/04* (2013.01); *A24F 9/02* (2013.01); *A24F 9/04* (2013.01)

(58) Field of Classification Search
CPC ..... A24F 9/02; A24F 9/04; A24F 9/06; A24F 9/08; A24F 9/10; A24F 9/12; A24F 9/14; A24F 9/16; A24F 23/00; A24F 23/02; A24F 23/04
USPC ..... 206/86, 236, 242, 244, 256
See application file for complete search history.

(56) References Cited

U.S. PATENT DOCUMENTS 34,308 A * 2/1862 Leslie ..... A24F 9/02 131/243
1,458,817 A * 6/1923 Gardner ..... A24F 23/04 206/86
2,939,575 A * 6/1960 Tarara ..... A24F 9/00 206/86
4,223,687 A * 9/1980 Sandeen ..... A24F 3/00 131/180
5,465,738 A * 11/1995 Rowland ..... A24F 23/04 131/180
6,138,822 A * 10/2000 Garcia ..... A24F 15/18 206/246
7,416,078 B2 * 8/2008 Willis ..... A24F 3/00 131/178
7,905,236 B2 * 3/2011 Bryman ..... A24F 3/00 131/351
8,408,390 B2 * 4/2013 Rennecamp ..... A24F 15/18 206/268
9,032,966 B2 * 5/2015 Geraths ..... A24F 1/00 131/180

(Continued)

*Primary Examiner* — Joshua E Rodden
(74) *Attorney, Agent, or Firm* — Richard Schretter

(57) ABSTRACT

A container for storage of smoking material, such as, for example, tobacco or the like, and related smoking accessories and a system and a method for using the same. Including a main body portion which has a first cavity for storing smoking material that extends downwardly from the upper face toward the bottom and has a cover at the top. The housing may have additional cavities in the body of the container for convenient storage of a pipe(s) and a cleaning tool. A second cover for these cavities operates independently of the material storage cavity cover. The assembly also includes an access hole in the body of the container with an additional cover that can be shifted to reveal access for a pipe to be inserted and guided directly into the the storage cavity in order to fill and pack the pipe with a portion of the smoking material.

2 Claims, 11 Drawing Sheets

(56) References Cited

U.S. PATENT DOCUMENTS

| | | | | |
|---|---|---|---|---|
| 10,562,033 | B2 * | 2/2020 | McDonough Migale | A47J 42/24 |
| 2008/0314778 | A1 * | 12/2008 | Hatton | A24F 9/16 206/256 |
| 2011/0068026 | A1 * | 3/2011 | Fakhouri | A24F 15/18 206/244 |
| 2017/0035105 | A1 * | 2/2017 | Jordan | A24F 7/04 |
| 2018/0228210 | A1 * | 8/2018 | Ackerman | A24B 7/00 |
| 2019/0092559 | A1 * | 3/2019 | Faircloth | B65D 85/109 |

* cited by examiner

SMOKING ACCESSORY CONTAINER

This application claims the benefit of U.S. Provisional Application Ser. No. 62/652,439, filed Apr. 4, 2018.

CROSS-REFERENCE TO RELATED APPLICATIONS

Several types of smoking pipe assemblies are known in the prior art.

For example, U.S. Pat. No. 4,214,658 to Crow a smoking pipe and smoking material are stored in a container having a removal upper sliding cover to permit access to the pipe and its smoking material.

In U.S. Pat. No. 5,465,738 to Rowland a smoking system is described which holds a smoking device, tobacco, filters and a cleaning rod.

U.S. Pat. No. WO 2013/016628 A1 is a modular storage receptacle for smoking material, for storing smoking material and a method for using the same.

U.S. Pat. No. US5967312AA is a flip top container used to store a smoking pipe and smoking material.

Classifications

A24F23/04 Tobacco pouches combined with other objects, e.g. with filling devices for pipe.

BACKGROUND OF THE INVENTION

This application claims the benefit of U.S. Provisional Application Ser. No. 62/652,439, filed Apr. 4, 2018.

BACKGROUND AND IMPROVEMENTS

The present invention generally relates to a container for storage of smoking material, such as, for example, tobacco or the like, and a system and a method for using the same. When pipes are used for the smoking implement, various types of containers have been used to store and transport the pipe and the necessary associated smoking material. Typically, one side of the container has a cover that slides or twists open to reveal the cavities for both the tools and the smoking material simultaneously. The present invention relates to one such container wherein the smoking material storage cavity is covered independently of the cavity that would store the pipe(s) and or tools. The present invention provides an alternate method to fill the pipe as well as a method to tamp and pack the material and also clearing the outer edge of the pipe of excess materials. Additional objects, attributes, and advantages of the invention are explained and illustrated in the following description and drawings.

SUMMARY OF THE INVENTION

The present invention generally relates to a container for storage of smoking material, such as, for example, tobacco or the like, and related smoking accessories and a system and a method for using the same. The convenience of having all needed accessories in one pocket sized container to make a kit, provides a useful benefit to those who choose to smoke using a pipe.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Depending on the region of the country, existing smoking kits are known by many names, like tobacco box, taster box or slang terms such as hitter box, dug out, one hit box, oneie, etc. This invention includes several improvements and advantages to the existing options that are available.

This invention stores a smoking material inside of a cavity that is inside of the body of the container, and also stores a cigarette sized pipe (commonly known as bat, one hitter, hitter, and many other slang terms depending on the region). Some versions may include additional cavities in the body of the container for convenient storage of accessories such as a lighter, an extra pipe or pipes, a convenient removable metal rod cleaning tool built into the body portion (known commonly as a poker, poker stick, cleaning tool or cleaning rod). This tool provides a quick convenient way to clear residue from the inside of a pipe.

a. A primary object of the present invention is to provide a container for storage of smoking material and related smoking accessories that will overcome the shortcomings of the prior art devices.
b. An additional object is to provide a container that fits comfortably in the palm of a hand for comfort and therefore is easier to hold and grasp.
c. Another object is to provide a larger capacity for storage of smoking materials to allow more material to be stored in the smoking material storage cavity, in turn this means one will need to refill the material storage cavity less often.
d. Another object is to provide a container for storage of smoking materials with a larger hole to fill the material storage cavity with smoking material and a second hole with a cover for pipe access to fill the pipe with smoking materials.
e. A further object is to provide ease and efficiency of loading the smoking materials into the smoking material storage cavity in order to minimize accidental spills.
f. A further object is to provide a container that includes a cavity with a cover to store a cigarette shaped pipe.
g. An additional object is to provide a simplified process to remove the pipe from the cavity, allowing the container to be turned upside down or tilted to slide the pipe out without the worry of spilling any smoking material.
h. A further object is to provide a container that includes a cavity to store a cleaning accessory, such as a cleaning rod tool for convenient clearing of residue from the inside of the pipe.
i. Another object is to provide a container that has two separate opening/closing and latching covers, one to encase the smoking material storage cavity and the second covering and encasing the pipe and accessory tool cavities, both covers operating independently.
j. Another object is to provide a container that has at minimum 3 separate holes with covers, one to encase the smoking material storage cavity and the second covering and encasing the pipe and accessory tool cavities and a third for the pipe access hole into the material storage cavity, all covers are able to operate independently.

k. A further object is to provide a method and system to fill the bowl portion of the pipe that allows the the user to grasp a larger portion of the pipe while attempting to fill the pipe.

l. Another object is to provide a container that will create an alternative to utilizing the top cover of the storage material cavity as the primary access and method to fill a pipe, thus preventing accidental spillage while loading the pipe.

m. Another object is to provide a container that has an access hole (creating a short shaft), through the body of the container leading into the material storage cavity the hole allows the pipe to be inserted and guided directly into the the smoking material storage cavity in order to fill and pack the pipe with a portion of the smoking material.

n. A further object is to provide a cover attached to the body of the container that an adult can shift, to either access, or close off, the hole and the shaft in the body of the container, as a method to minimize accidental spills from the smoking material storage cavity access hole.

o. A further object is to provide a container that includes an access hole in the body of the container with a cover that can be shifted to reveal access, and allow a pipe to be inserted through the hole and into an area inside of the material storage cavity designed to be ideal for filling the bowl end of the pipe.

p. An additional object is to position the access hole and shaft to provide an ideal loading angle through the body and into a loading zone located within the material storage cavity, the form and shape of the loading zone will allow even the smallest amount of smoking material to be transferred to the bowl portion of the pipe.

q. Another object is to provide a method to tamp or pack the smoking material to the desired density within the bowl of the pipe.

r. A further object is to provide a tamping accessory tool for convenient packing the smoking material to the desired density within the bowl of the pipe.

s. A further object is to provide a method to conveniently clear any excess residual smoking material from the outer edge of the bowl portion of the pipe to prevent waste and also returning any excess smoking material back into the material storage cavity while keeping the outer edge of the bowl portion of the pipe cleaner.

t. An additional object is to provide a cleaning accessory tool to conveniently clear any excess residual smoking material from the outer edge of the bowl portion of the pipe to prevent waste and also returning any excess smoking material back into the material storage cavity while keeping the outer edge of the bowl portion of the pipe cleaner.

u. A further object is to provide include a built in cleaning accessory tool for simple cleaning of the interior of the bowl portion of the pipe.

Further objects of the present invention will appear and become obvious to the reader as the description proceeds and it is intended that these objects and advantages are within the scope of the present invention: To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

ITEM # BRIEF DESCRIPTION OF COMPONENTS

Figure 1:
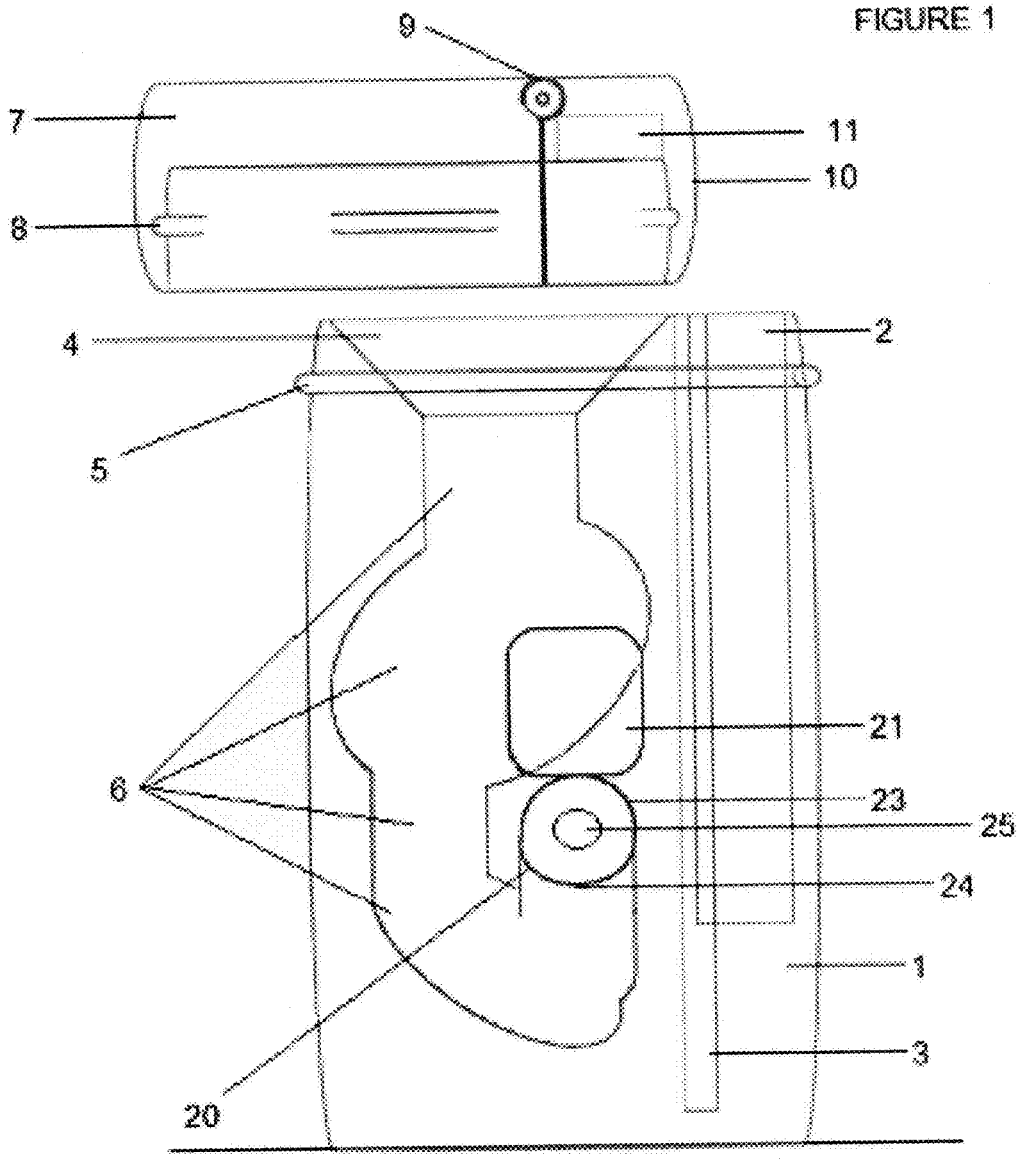
FIG. 1 is a front transparent view of container and cover to show the internal components of the invention.
Figure 2:
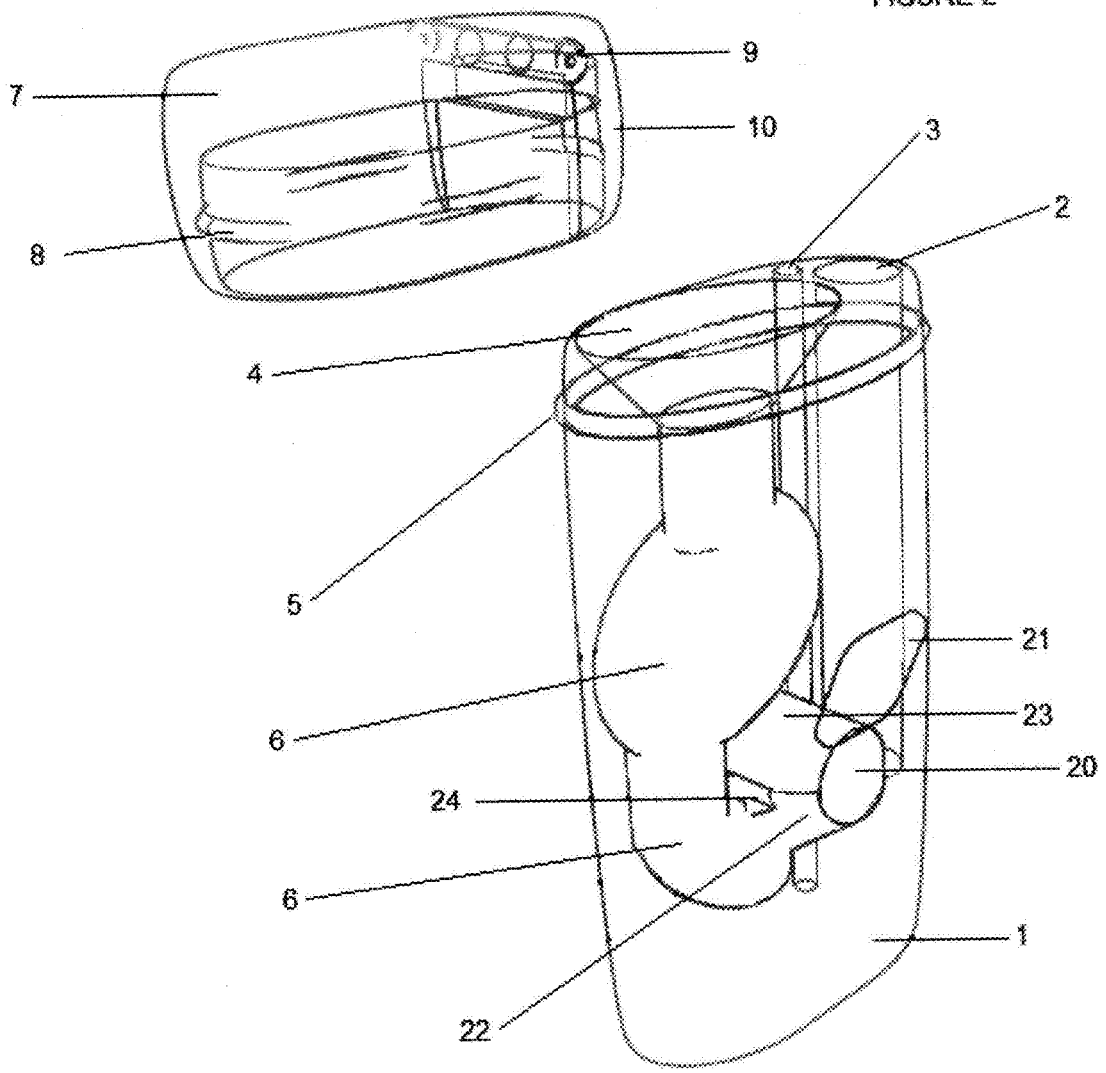
FIG. 2 is a front perspective transparent view of container and cover to show the internal components of the invention.
Figure 3:
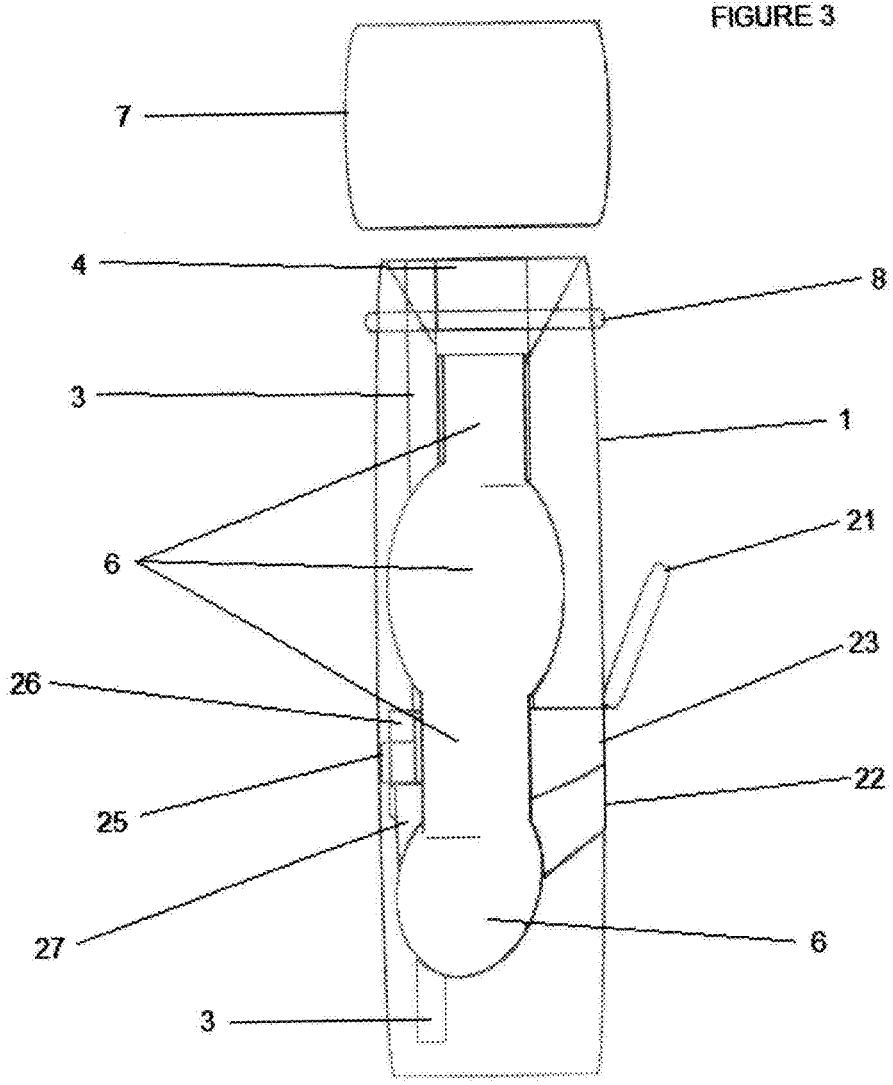
FIG. 3 is a left side transparent view of container and cover is shown as solid to show the internal components of the invention.
Figure 4:
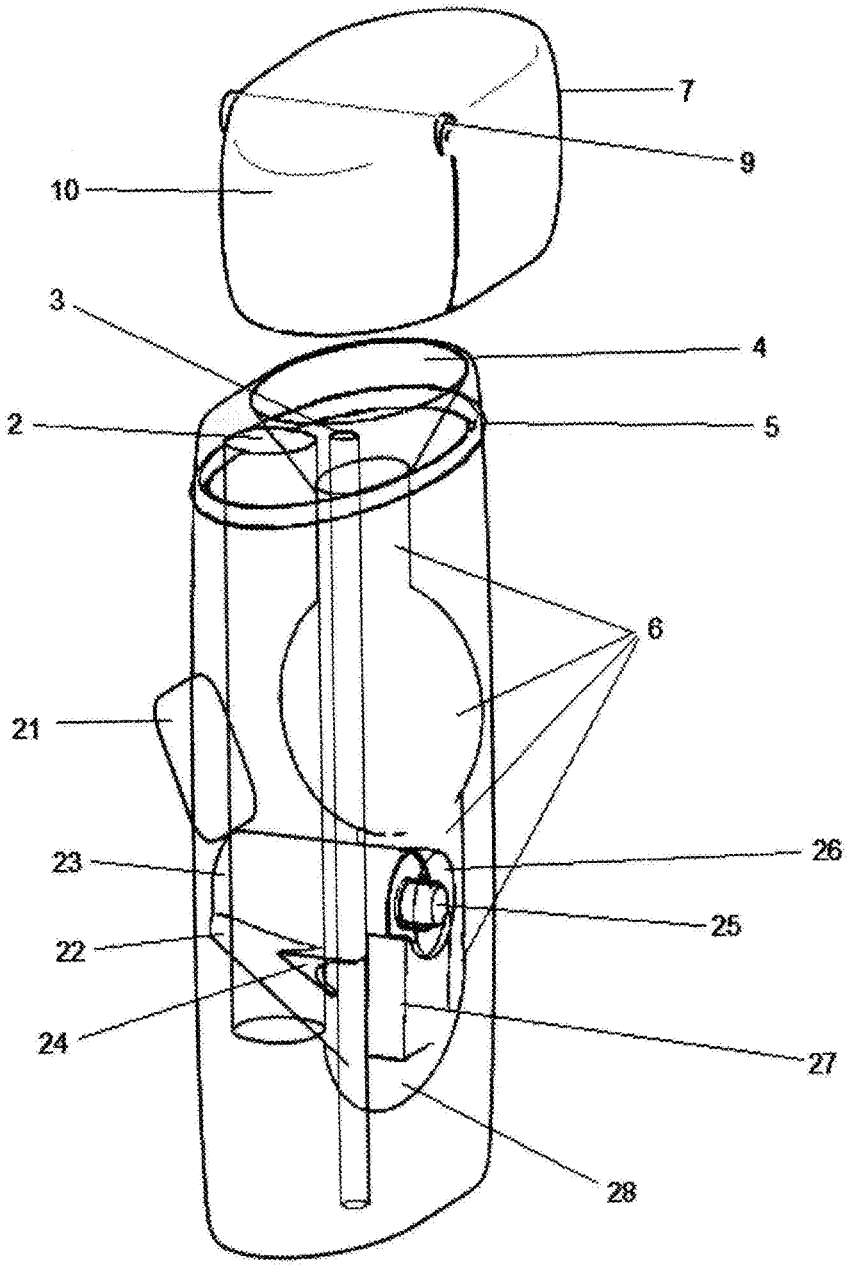
FIG. 4 is a rear transparent view of container and cover is shown as solid to show the internal components of the invention.
Figure 5:
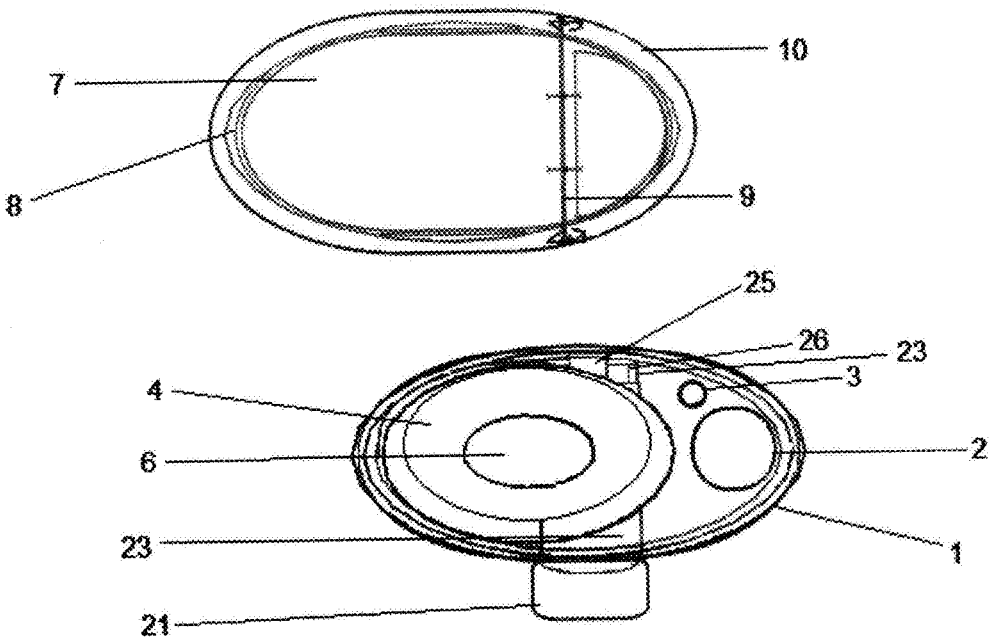
FIG. 5 is a top transparent view of container and cover to show the internal components of the invention.
Figure 6:
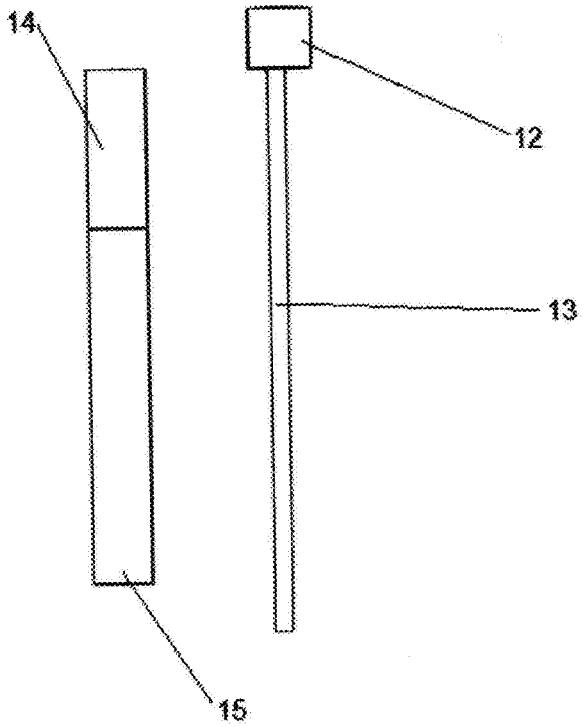
FIG. 6 is front view of cigarette shaped pipe and cleaning tool with a handle

1 Container (Smoking Material Container)
2 Pipe storage cavity
3 Cleaning rod cavity
4 Material Storage access
5 Cap ridge
6 Material Storage cavity
7 Material Storage cover
8 Cap indentation
9 Cover hinge
10 Accessory cover
11 Additional hollowed area for tool storage
12 Cleaning tool handle
13 Cleaning rod
14 Cigarette shaped pipe
15 Bowl portion of the pipe
20 Pipe Access hole
21 Pipe access cover
22 Loading cavity/shaft
23 Tamping cavity/shaft
24 Pipe Guide
25 Tamping tool
26 Pipe scraping tool
27 Excess material return cavity
28 Sculpted pipe loading area

DETAILED DESCRIPTION OF THE DRAWINGS

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The present invention generally relates to a container for storage of smoking material (1), such as, for example, tobacco or the like, and related smoking accessories and a system and a method for using the same. The convenience of having all needed accessories in one pocket sized container to make a kit, provides a useful benefit to those who choose to smoke using a pipe.

Figure 7:
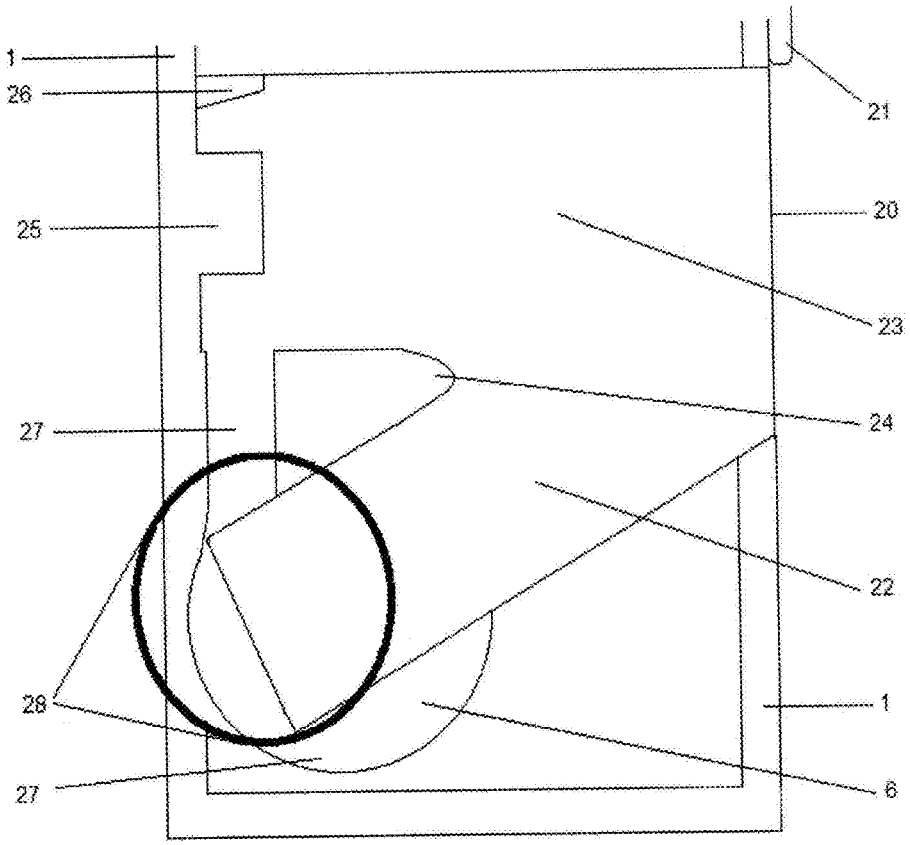
FIG. 7 is a cross section side view of the lower portion of the container to show more detail on loading and tamping shafts.
Figure 7A:
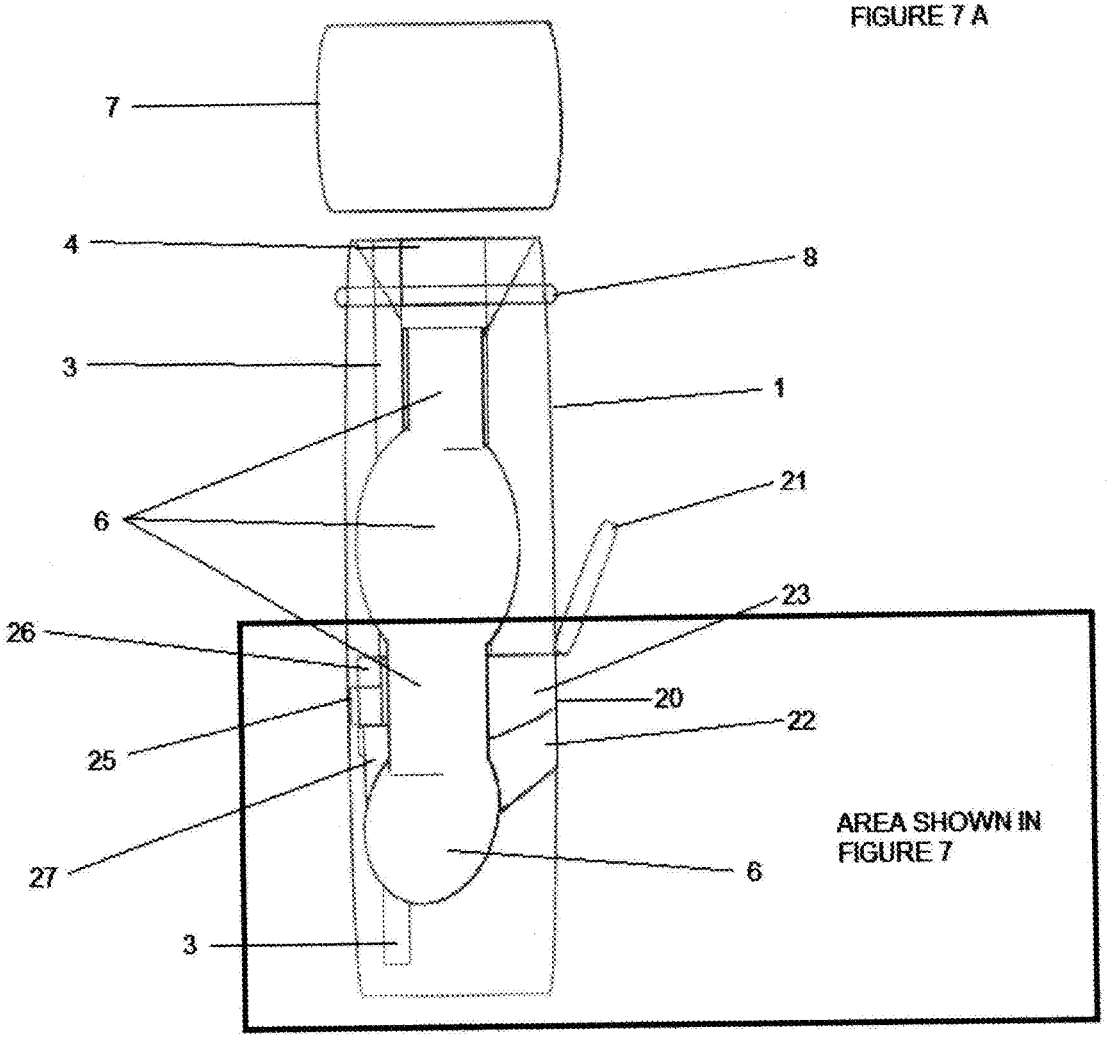
FIG. 7*a* shows the portion of the invention as depicted in FIG. 7.
Figure 7B:
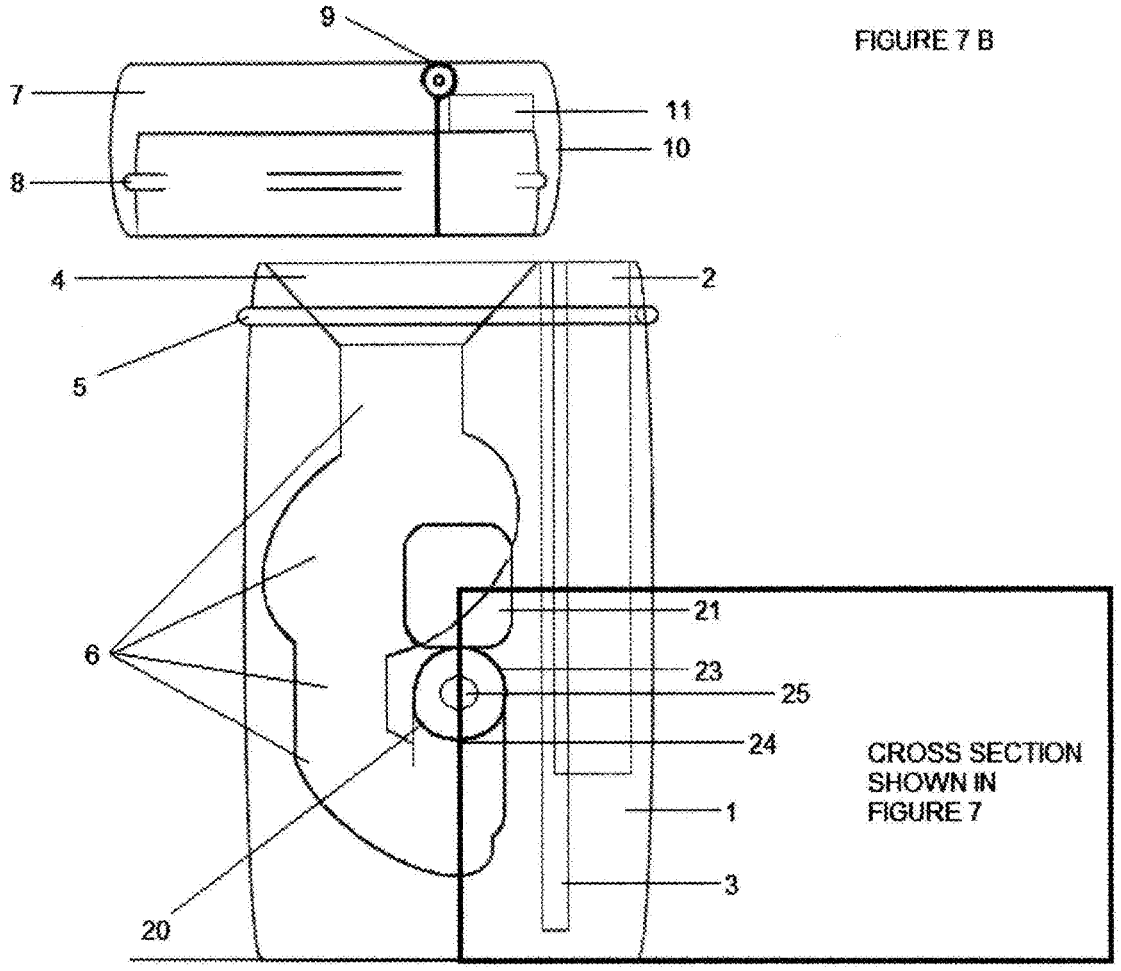
FIG. 7*b* shows the portion of the invention as depicted in FIG. 7.
Figure 8:
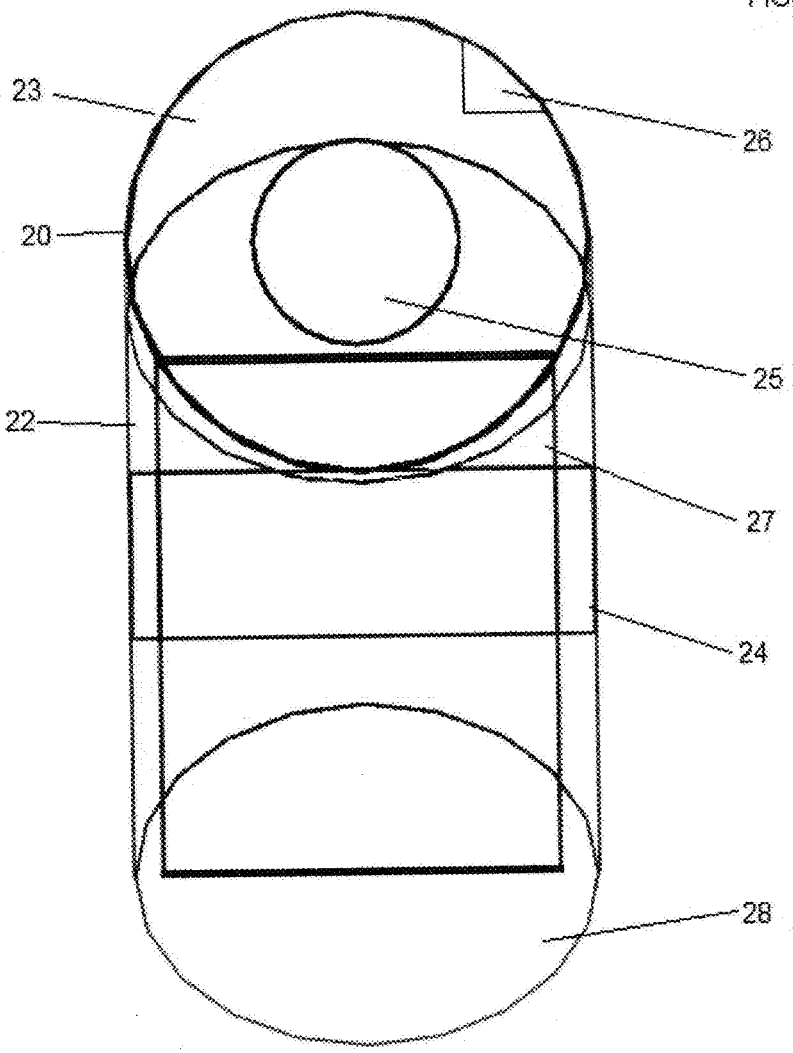
FIG. 8 is a transparent front view of the loading and tamping shafts.
Figure 9:
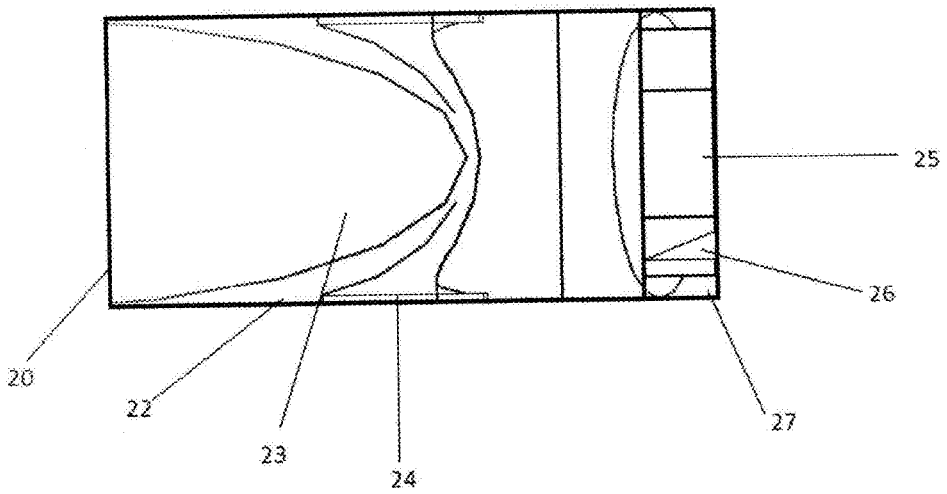
FIG. 9 is a transparent top view of the loading and tamping shafts.

FIGS. 1-6 show transparent views of the container to best show the internal components. The body of the container (1) is a rounded rectangular shape to fit comfortably in the palm of a hand. Several cavities are contained within the container. The first cavity (6) has a larger opening (4) at the top of the cavity in order to funnel a smoking material to a material storage cavity (6) in this embodiment shows several chambers that together make up the material storage cavity (6). A second cavity (2) in the body of the container stores a cigarette sized pipe (14) (commonly known as bat, one hitter, hitter, and many other slang terms depending on the region). This version includes an additional cavity (3) in the body of the container (1) for convenient storage of accessories such a convenient removable metal rod cleaning tool (13). This tool has a handle (12) and provides a quick convenient way to clear residue from the inside of a pipe. The face of the body of the container (1) has two cylindrical cavities (23) and (22). FIGS. 7-9 show details of tampeng shaft (23) and loading shaft (22)/that merge at the face of the body of the container to create the pipe access hole (20) in the face of the container (1). This hole has a cover that can be opened and closed to reveal the pipe access hole (20). Cavities (23) and (22) are attached at the interior of the merge point with a pipe guide (24) this guide will allow a pipe to be directed intentionally into either cavity. The internal end of cavity (22) extends directly into the material storage container (6). The interior wall of the storage container (6) is to contain a dimple (28) where the pipe is directed when inserted through the pipe access hole (20). This dimple (28) is to be located in the ideal spot and have the ideal shape for the bowl portion of the pipe (15) to be filled with the smoking material that is stored in the material storage chamber (6). The internal end of cavity (23) contains a tamping tool (25). This tamping tool (25) is a small cylinder protruding from the interior wall of the body of the container (1) into the cavity (23). The tamping tool (25) is slightly smaller than the interior circumference of the bowl portion of the pipe (15). Surrounding the tamping tool (25) at the interior end of the cavity (23) is an angled beveled edge that is very slightly larger than the outer edge of the bowl portion of the pipe. The bevelled edge pipe scraping tool (26) cleans the exterior portion of the bowl end (15) of the pipe (14). The bottom portion of the cavity (23), only below the tamping tool (25) contains a hollow cavity (27) that will allow excess smoking materials to drop back into the storage cavity (6) when the pipe scraping tool (26) is used. Cavity (23) can also be called the tamping shaft, and cavity (23) can be called the pipe loading shaft.

The container (1) has a cover (7) this embodiment shows the cover as completely removable, other embodiments have alternative covers attached to the body of the container. This cover (7) has a hollowed out area on the bottom side that allows it to cap the container (1) and snaps on to the container at the cap indentation (8) kept in place by the cap ridge (5) that is protruding slightly from the body of the container (1) to match with the cap indentation and securely cover the top of the body of the container (1). The cap also contains a hinge (9) that allows the opening just a of part of the cover that is above the tool and accessory cavities. The accessory cover (10) portion can open and closed independent of the cover (7) for the material storage cavity. Thus allowing the accessories (13) and (14) to be accessed and removed or inserted without uncovering the material storage chamber opening (4).

Using the invention one would begin by removing or opening the cover (7) and insert a smoking material through material storage access funnel (4) and it will continue to funnel into the material storage cavity (6). Once the desired amount of smoking material is inserted the cover can be replaced or closed. The user would next open the smaller portion of the cover (10) and remove the pipe (14) from the cavity (2) where the pipe (14) is stored. The accessory cover (10) can then be closed. With the container (1) held in the palm of a hand with the access hole (20) and cover (21) facing away from the palm. Next the cover (21) is opened revealing the pipe access hole (20) and cavities 22 and 23 also referred to as the loading shaft and the tamping shaft respectively. Holding the pipe (14) with the opposite hand that is holding the container (1) the pipe is inserted through the pipe access hole (20) and pushed into the material storage cavity (6) and the bowl portion of the pipe is filled with the smoking material. The pipe (14) can then be partially withdrawn from the loading shaft (22) and adjust the angle of insertion to guide the pipe (14) into the tamping shaft (23). Once some material is tamped into the bowl portion of the pipe (15) the process can be repeated to pack the material to the desired density.

While tamping the material into the bowl portion of the pipe (15) the pipe (14) can be rotated to engage the outer edge of the bowl portion of the pipe (14) with the pipe scraping tool (26) located around the tamping tool (25). When the pipe is packed to the desired density with the smoking material and the outer edge has been cleaned, the pipe can be removed from the pipe access hole (20) and shafts (22) and (23) and the cover (21) can be returned to the closed position. The pipe (14) is now packed and ready for smoking. Once the material has been consumed the cover (10) can be opened and the cleaning rod (13) can be removed, the pipe (14) is cleared with the cleaning rod (13) then the tools can be returned to the container (1) where it is stored in the cavity (2) and cavity (3).

The embodiments of the invention in which an exclusive property or privilege is claimed are defined as follows:

1. A storage container comprising:

a. a container having a to end and a bottom end, wherein the bottom end is located in a position opposite to the top end;

b. a first cavity extending from the top end of the container and extending into a body of the container, the first cavity connected to a material storage cavity for storage of a smoking material;

c. a second cavity in the body of the container for storage of a pipe, wherein the second cavity has a cylindrical shape and further wherein the second cavity extends from the top end of the container into the body adjacent to the first cavity;

d. a third cavity in the body of the container for storage of a cleaning tool, wherein the third cavity has a cylindrical shape;

e. the third cavity extends from the top end of the container into the body of the container to a position adjacent to the second cavity;

f. a first top cover that covers the first cavity and is configured to be secured to the body of the container;

g. a second top cover that covers the second cavity and the third cavity, wherein the second top cover is configured to operate independently of the first cover for the first cavity;

h. a fourth cavity in the container, wherein the fourth cavity has a cylindrical shape configured to have a shaft slightly larger than a circumference of a pipe and further wherein the forth cavity extends from a face of the body of the container and extends into the material storage cavity;

i. a fifth cavity merges with the fourth cavity near the face of the body of the container, wherein the fifth cavity has a cylindrical shape configured to create a shaft slightly larger than the circumference of the pipe, the fifth cavity forming a tamping shaft;

j. the material storage cavity contains a formed reservoir within the material storage cavity configured to have an area slightly larger than the circumference of the pipe for ideal loading of the pipe directly in line with the forth cavity shaft;

k, a tamping accessory tool configured for convenient packing the smoking material to the desired density within a bowl of pipe;

l. a small cylinder protruding from a wall of the body of the container with a circumference configured to be slightly smaller than an inner bowl portion of the pipe, the small cylinder extending parallel to the fifth cavity and forming a tamping tool;

m. a sixth cavity located within the is of the container connecting a back of the fifth cavity with the material storage cavity, the sixth cavity configured to return any excess smoking material cleared into the material storage cavity;

n. an area surrounding the tamping tool on an inner edge of the tamping shaft contains an angled beveled edge configured to be larger than the circumference of the pipe clearing any excess residual smoking material from an outer edge of the bowl portion of the pipe, the angled beveled edge within the tamping shaft configured to scrape the outer edge of the bowl portion of the pipe.

2. A method of using a storage container to tamp or pack smoking material to a desired density within a bowl of a pipe, the method comprising:

a. a container having a top end and a bottom end, wherein the bottom end is located in a position opposite to the top end;

b. a first cavity extending from the top end of the container and extending into a body of the container, the first cavity connected to a material storage cavity storing the smoking material;

c. a second cavity in the body of the container for storage of a pipe, wherein the second cavity has a cylindrical shape and further wherein the second cavity extends from the top end of the container into the body adjacent to the first cavity;

d. a third cavity in the body of the container for storage of a cleaning tool, wherein the third cavity has a cylindrical shape;

e. the third cavity extends from the top end of the container into the body of the container to a position adjacent to the second cavity;

f. a first top cover that covers the first cavity and is configured to be secured to the body of the container;

g. a second top cover that covers the second cavity and the third cavity, wherein the second top cover is configured to operate independently of the first cover for the first cavity;

h. a fourth cavity in the container, wherein the fourth cavity has a cylindrical shape having a shaft slightly larger than a circumference of the pipe and further wherein the fourth cavity extends from a face of the body of the container and extends into the material storage cavity;

i. a fifth cavity merges with the fourth cavity near the face of the body of the container, wherein the fifth cavity has a cylindrical shape having a shaft slightly larger than the circumference of the pipe, the fifth cavity forming a tamping shaft;

j. the material storage cavity contains a formed reservoir within the material storage cavity having, an area slightly larger than the circumference of the pipe for loading of the pipe directly in line with the forth cavity shaft;

k. a tamping accessory tool configured for convenient packing the smoking material to the desired density within a bowl of pipe;

l. a small cylinder protruding from a wall of the body of the container with a circumference slightly smaller than an inner portion of the bowl of the pipe, the small cylinder extending parallel to the fifth cavity and forming a tamping tool;

m. a sixth cavity located within the body of the container connecting a back of the fifth cavity with the material storage cavity, the sixth cavity returning any excess smoking material cleared into the material storage cavity;

n. an area surrounding the tamping tool on an inner edge of the tamping shaft contains an angled beveled edge larger than the circumference of the pipe clearing, any excess residual smoking material from an outer edge of the bowl portion of the pipe, the angled beveled edge within the tamping shaft scraping the outer edge of the bowl portion of the pipe;

o. using the container to tamp or pack the smoking material to a desired density within the bowl of the pipe.

* * * * *